US008181701B2

(12) United States Patent
Yokley et al.

(10) Patent No.: US 8,181,701 B2
(45) Date of Patent: May 22, 2012

(54) DOWNHOLE TOOL WITH HYDRAULIC CLOSURE SEAT

(75) Inventors: John M. Yokley, Kingwood, TX (US); Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 281 days.

(21) Appl. No.: 12/486,022

(22) Filed: Jun. 17, 2009

(65) Prior Publication Data

US 2010/0319927 A1 Dec. 23, 2010

(51) Int. Cl.
*E21B 33/12* (2006.01)

(52) U.S. Cl. ..... 166/194; 166/192; 166/193; 166/209; 166/318

(58) Field of Classification Search ..... 166/192, 166/193, 194, 209, 318
See application file for complete search history.

(56) References Cited

U.S. PATENT DOCUMENTS

| | | | | |
|---|---|---|---|---|
| 4,828,037 | A | 5/1989 | Lindsey et al. | |
| 4,923,938 | A | 5/1990 | Kao et al. | |
| 5,244,044 | A | 9/1993 | Henderson | |
| 5,332,045 | A * | 7/1994 | Ross et al. | 166/387 |
| 5,553,672 | A | 9/1996 | Smith, Jr. et al. | |
| 6,367,552 | B1 * | 4/2002 | Scott et al. | 166/355 |
| 6,681,860 | B1 | 1/2004 | Yokley et al. | |
| 6,866,100 | B2 | 3/2005 | Gudmestad et al. | |
| 2007/0272420 | A1 * | 11/2007 | Reimert et al. | 166/387 |
| 2010/0038096 | A1 * | 2/2010 | Reimert et al. | 166/382 |

FOREIGN PATENT DOCUMENTS

GB 2437652 A * 10/2007

* cited by examiner

*Primary Examiner* — Daniel P Stephenson
*Assistant Examiner* — Ronald Runyan
(74) *Attorney, Agent, or Firm* — Streets & Steele

(57) ABSTRACT

A downhole tool 100 includes closure seats 116, 176 for seating with a closure, such as a ball. Shear pins or other connectors temporarily limit axial movement of each closure seat which is initially housed within a restricted diameter portion of the central throughbore in the tool body. A piston axially moves in response to fluid pressure to pressurize fluid in a chamber and controllably release fluid through one or more restrictions. The closure seat may be lowered to engage a stop 108, 159, such that the seat may move axially to an enlarged diameter bore portion of the tool, thereby allowing radial expansion of a closure seat to release the ball.

20 Claims, 12 Drawing Sheets

DOWNHOLE TOOL WITH HYDRAULIC CLOSURE SEAT

FIELD OF THE INVENTION

The present invention relates to downhole tools adapted for receiving a ball or other closure member to provide for the increase in fluid pressure above the seated closure within the tool, thereby actuating components within the tool or within another tool. More particularly, the present invention relates to a liner hanger assembly for hanging a liner in a well, and to a relatively simple and highly reliable hydraulic closure seat which allows a ball to reliably pass by the seat after desired tool operations are complete.

BACKGROUND OF THE INVENTION

Various types of downhole tools are adapted for utilizing an increase in fluid pressure to actuate components of the tool. Packer setting tools, multi-lateral tools and liner hangers are plus exemplary of downhole tools which rely upon an increase in fluid pressure above a seated closure to actuate the tool.

Some tools utilize collet fingers as a ball seat, so that the collet fingers are shifted from the contracted position to an expanded position to allow the ball to drop through the expanded ball seat. Various problems with this design may occur when the collet fingers fail to properly seal and do not allow for pressure to build up so that the collet fingers can move downward and let the ball drop through the seat. Another problem with this type of expandable ball seat is that wellbore fluids pass by the collet fingers, thereby eroding the fingers and tending to cause the ball seat to fail. A ball seat design with collet fingers may also fail to seal properly and not allow for the pressure to build up so that the collets release to pass the ball through the seat. U.S. Pat. Nos. 4,828,037, 4,923,938, and 5,244,044 are examples of patents disclosing expandable ball seats.

U.S. Pat. No. 5,553,672 discloses another design for setting a ball on a seat. This design relies upon a rotating ball valve, so that in one position there is a small hole in the valve which acts as the ball seat. A small ball lands on the small hole, and pressure is applied to the tool. Pressure is applied to rotate the ball, allowing the small ball to drop. This design is complicated with many parts and components that may cause failure.

U.S. Pat. No. 6,681,860 discloses a yieldable ball seat. Quality control for the expandable area may be difficult, and the expandable ball seat may not yield when intended. Material control is also important since the expandable areas expand at a certain pressures. Expandable ball seats thus do not always reliably release the ball at a preselected pressure. In some situations, pressure used to release the ball from the upper seat may generate a full force sufficient to pass the ball through the lower seat, which then makes it impractical to further operate the tool. High pressure applied to the ball releasing system may also damage the tool or damage the skin of the downhole formation.

U.S. Pat. No. 6,866,100 discloses a mechanically expanding ball seat which utilizes pipe manipulation of a drill string after the liner hanger is set to open the seat and release the ball. This system releases the ball mechanically rather than using fluid pressure. The design as disclosed in this patent is complicated, and one has to equalize the pressure across the ball seat before mechanically manipulating the drill string to release the ball.

The disadvantages of the prior art are overcome by the present invention and an improved downhole tool with a C-ring closure seat for receiving a ball or other closure member is hereinafter disclosed.

SUMMARY OF THE INVENTION

According to one embodiment, a liner hanger assembly includes a tool mandrel supported from a running string, a slip assembly for setting slips to engage the casing and support the liner hanger from the casing, and a releasing mechanism for releasing the set liner hanger from portions of the tool returned to the surface. The liner hanger assembly further comprises an expandable closure seat positioned about a central flow path in the tool for seating the closure member. A seal is provided above the closure for sealing with the ball or other closure member when seated on the closure. A connector, such as a shear pin, is disabled to release the closure for axial movement in response to a predetermined fluid pressure above the ball. A desired liner hanger operations may be performed with increasing fluid pressure controlled by the operator at the surface. In another embodiment, the closure seat and the releasing member may be provided in other downhole tools, including a production packer, a downhole setting tool, or a multilateral tool.

These and further features and advantages of the present invention will become apparent from the following detailed description, wherein reference is made to the figures in the accompanying drawings.

DETAILED DESCRIPTION OF PREFERRED EMBODIMENTS

Figure 1A:
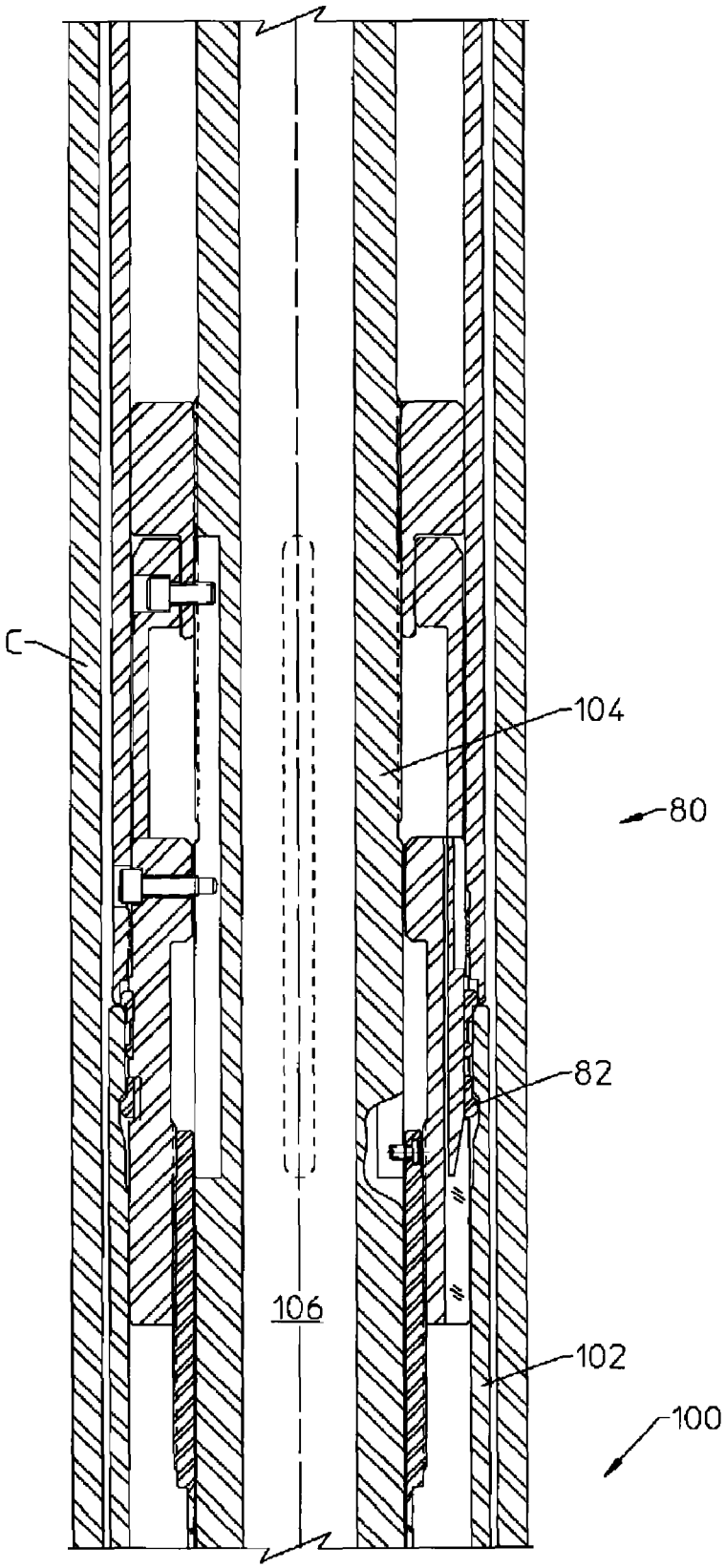
FIGS. 1A through 1G illustrate sequentially the primary components of a suitable liner hanger running tool.
Figure 1B:
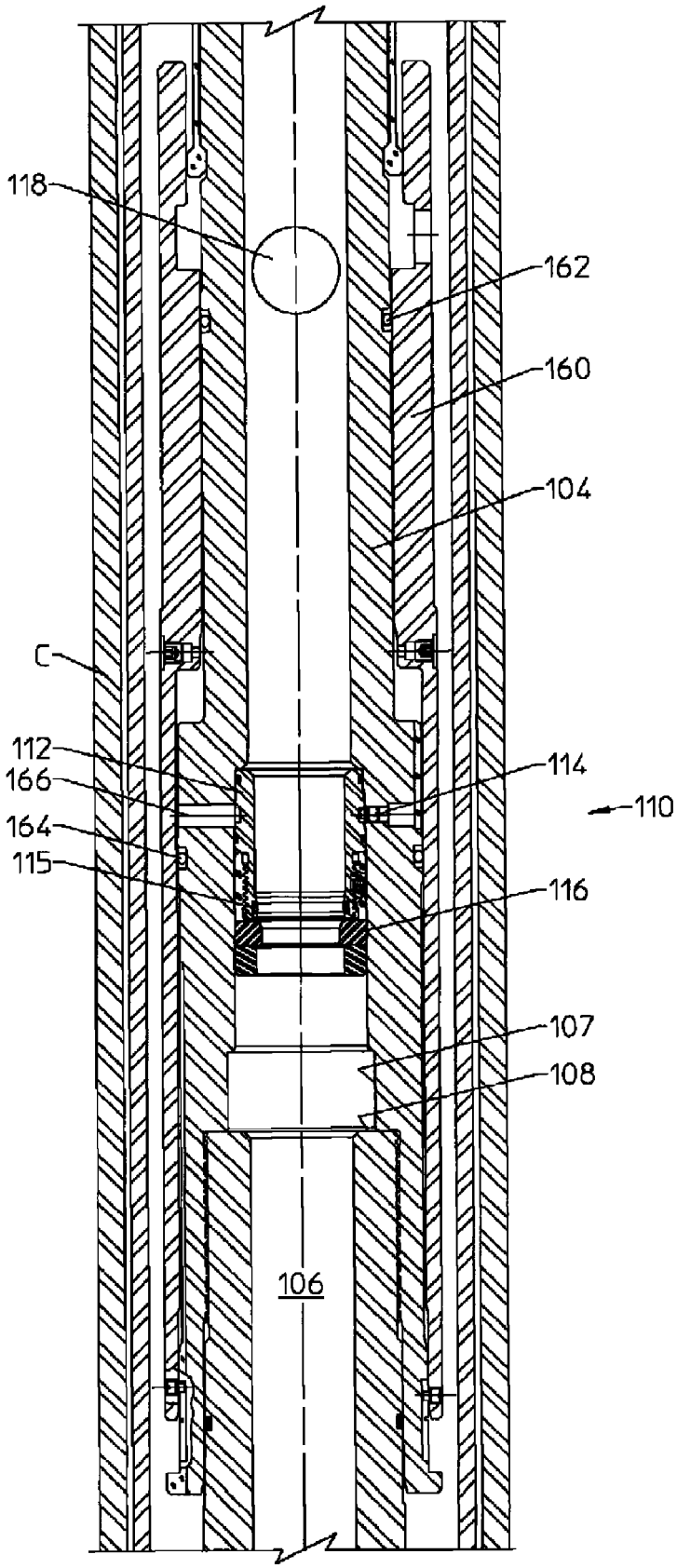
Figure 1C:
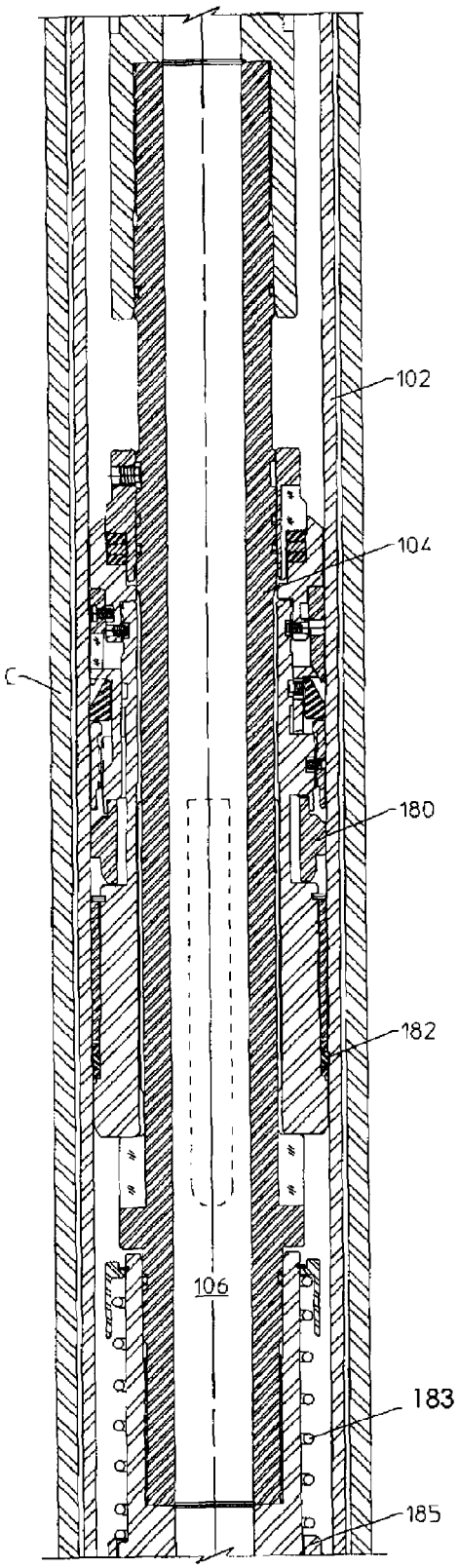
Figure 1D:
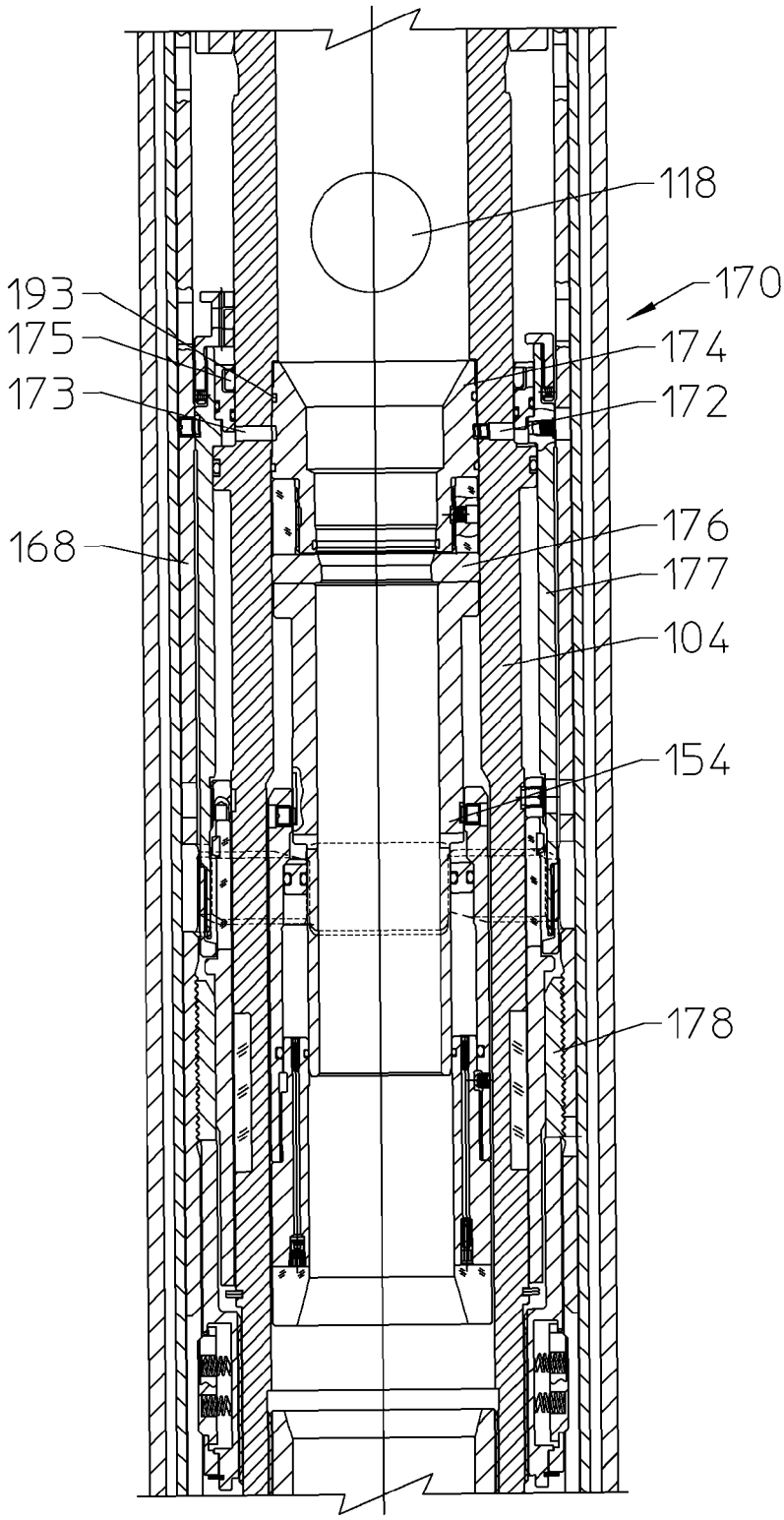
Figure 1E:
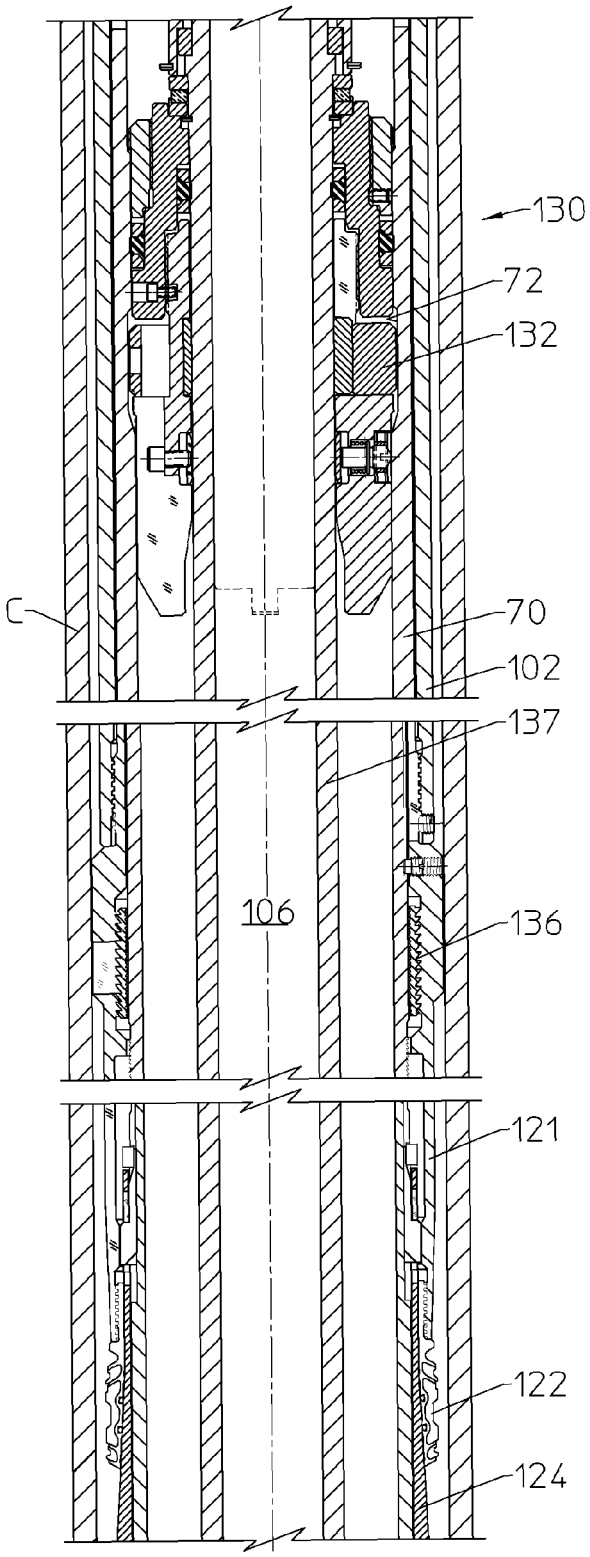
Figure 1F:
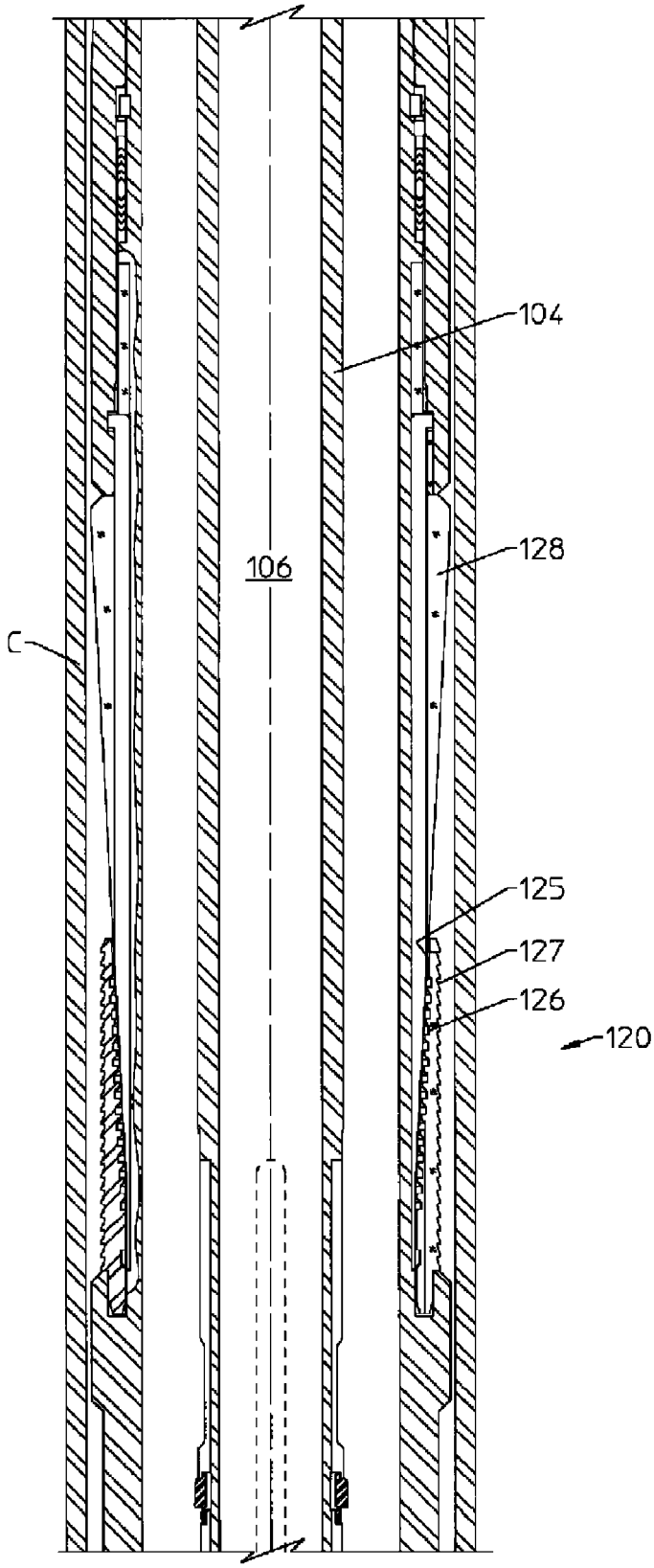
Figure 1G:
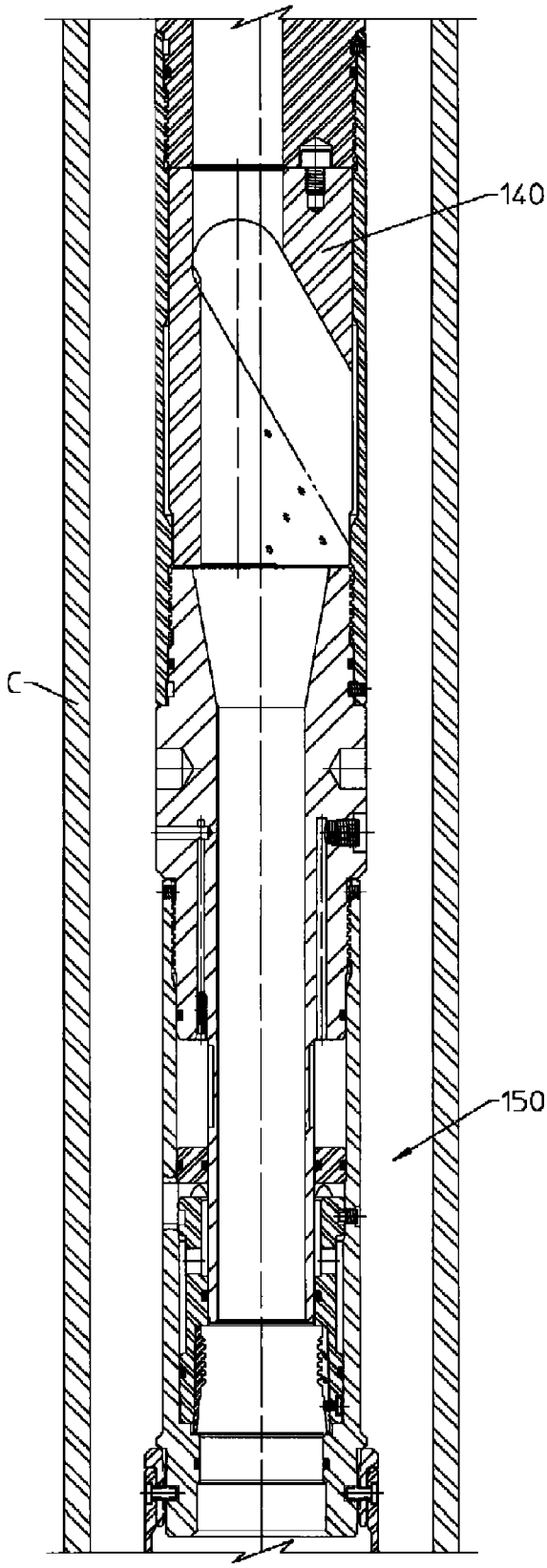

FIG. 1, which consists of FIGS. 1A-1G, illustrates one embodiment of a liner hanger running tool 100 with two closure subassemblies each for seating with a closure member in a liner hanger application. An upper closure subassembly 110 is shown in FIG. 1B, and a lower C-ring seat or closure seat subassembly 170 is shown in FIG. 1D. Other than components associated with seating and releasing the closure member, the primary components of the liner hanger running tool 100 as shown in FIG. 1 include a running tool tieback locking mechanism 80 (FIG. 1A), a slip release assembly operatively responsive to the upper C-ring seat assembly 110, packer setting lugs 180 (FIG. 1C), a liner hanger release assembly operatively responsive to the lower C-ring seat assembly (FIG. 1D), a cementing bushing 130 (FIG. 1E), and a ball diverter 140 and plug release assembly 150 (FIG. 1G). FIG. 1E illustrates the packer 122 and FIG. 1F illustrates the slip assembly 120, which are not part of the running tool retrieved to the surface, and remain downhole with the set liner. The closure seat subassemblies disclosed more fully below are used in the liner hanger running tool to activate the slip assembly using an upper closure seat 110, and to separately activate a liner hanger releasing assembly using a lower closure seat 170. The function served by each closure seat will thus vary with the tool functions being activated, and the pressure levels and sequencing of the tool.

To hang off a liner, the running tool 100 is initially attached to the lower end of a work string and releasably connected to the liner hanger, from which the liner is suspended for lowering into the bore hole beneath the previously set casing or liner C.

A tieback receptacle 102 as shown in FIG. 1A is supported about the running tool 100. The upper end of the tieback receptacle 102, upon removal of the running tool, provides for a casing tieback (not shown) to subsequently extend from its upper end to the surface. The tool 100 includes a central mandrel 104, which may comprise multiple connected sections, with a central bore 106 in the mandrel. The lower end of the tieback receptacle 102 is connected to the packer element pusher sleeve 121, as shown in FIG. 1E, whose function will be described in connection with the setting of the packer element 122 about an upper cone 124, as well as setting of the slips 126 about a lower cone 128 (see FIG. 1F).

The liner hanger running tool 100 also includes a cementing bushing 130 (see FIG. 1E), and a ball diverter 140 (see FIG. 1G) at the lower end of the running tool. The cementing bushing 130 provides a retrievable and re-stabbable seal between the running tool 100 and the liner hanger assembly for fluid circulation purposes. By incorporating an axially movable slick joint 137 as shown in FIG. 1E (which may functionally be an extension of the mandrel 104), the running tool may be axially moved relative to components to remain in the well without breaking the seal provided by the cementing bushing 130.

FIG. 1A also illustrates a tieback locking mechanism 80. A split ring 82 locks the tieback 102 to the running tool mandrel 104. The tieback locking mechanism prevents premature actuation of the tool as it is run in the well. The locking mechanism 80 unlocks the tieback 102 to allow the slips 126 to be set. More particularly the slips 126 are kept from prematurely setting as the tool 100 is run into the wellbore by the tieback locking mechanism 80, which grippingly engages the upper end of the tieback 102 to prevent its upward movement prior to setting the slips.

The upper closure subassembly 110 as shown in FIG. 1B is used to release the liner hanger slips for setting, and includes a sleeve 112 disposed within and axially movable relative to the running tool mandrel 104. The sleeve 112 is held in its upper position by shear pins 114. A C-ring ball seat 116 is supported on the sleeve 112. A seal 115 is provided for sealing with the seated ball. A ball 118 may thus be dropped from the surface into the running tool bore 106 and onto the seat 116. An increase in fluid pressure within the mandrel 104 above the seated ball will shear the pins 114 and lower the ball seat 116 and sleeve 112 to a lower position in the bore of the running tool, e.g., against the stop shoulder 108. Once the subassembly is lowered, fluid pressure may pass through ports 166 to stroke a piston and thereby release the slips for setting.

Piston sleeve 160 is disposed about and is axially movable relative to mandrel 104. An upper sealing ring 162 is disposed about a smaller O.D. of the running tool mandrel than is the lower sealing ring 164 to form an annular pressure chamber between them for lifting the tieback receptacle 102 from the position shown in FIG. 1B to an upper position for setting the slips or slip segments 126. Ports 166 formed in the running tool mandrel 104 connect the running tool bore with the surrounding pressure chamber once the seat 116 and sleeve 112 are lowered. An increase in pressure through the ports 166 will raise the piston sleeve 160. Upward movement of the piston sleeve 160 causes its upper end to raise the tieback receptacle 102, and also raise the slips 126.

The slip assembly 120 shown in FIG. 1F is made up of arcuate slip segments 126 received within circumferentially spaced recesses in slip body sleeve about the lower end of the liner hanger and adjacent the lower cone 128. Each slip segment 126 includes a relatively long tapered arcuate slip having teeth 127 on its outer side and an arcuate cone surface 125 mounted on its inner side for sliding engagement with lower cone 128. When three circumferentially spaced slip segments are used, each of three recesses may include a slot in each side. Alternatively, a one piece C-slip may be used to replace the slip segments. The teeth 127 are adapted to bite into the casing C as the liner weight is applied to the slip. The slips 126 are thus movable vertically between a lower retracted position, wherein their outer teeth 127 are spaced from the casing C, and an upper position, wherein the slips 126 have moved vertically over the cone 128 and into engagement with the casing C.

FIGS. 1E and 1F show the relationship of both the packer element 122 and the circumferentially spaced slips 126 about the upper 124 and lower 128 cones, respectively. The annular packer element 122 is disposed about a downwardly-enlarged upper cone 124 beneath the pusher sleeve 121. The packer element 122 is originally of a circumference in which its O.D. is reduced and thus spaced from the casing C. However, the packer element 122 is expandable as it is pushed downwardly over the cone 124 to seal against the casing.

FIG. 1E also illustrates the cementing bushing 130. The cementing bushing provides a retrievable and re-stabbable seal between the running tool and the liner hanger for fluid circulation purposes. The cementing bushing 130 cooperates with the slick joint 137 to allow axial movement without breaking the seal provided by the cementing bushing. The mandrel 104 of the released running tool can be used to raise the cementing bushing 130 to cause the lugs 132 to move in and unlock from the liner hanger. The liner hanger 70 is shown with an annular groove 72 for receiving the lugs 132. The cementing bushing 130 seals between a radially outward liner running adapter of the liner hanger and a radially inward running tool mandrel.

Ratchet ring 136 is also shown in FIG. 1E. This ratchet ring allows the packer element 122 to be pushed downward over the upper cone 124, then locks the packer element in its set position.

The packer element 122 may be set by using spring-biased pusher C-ring 180 (see FIG. 1C) which, when moved upwardly out of the tieback receptacle 102, will be forced to an expanded position to engage the top of the tieback receptacle. The released running tool may be picked up until the packer setting subassembly is removed from the top of a tieback receptacle, so that the pusher C-ring 180 is raised to a position above the top of the tieback receptacle and expanded outward. When the packer setting assembly is in this expanded position, weight may be slacked off by engaging the pusher C-ring 180 to the top of the tieback 102, which then causes the packer element 122 to begin its downward sealing sequence. When weight is set down, the expanded pusher C-ring 180 transmits this downward force through the tieback receptacle 102 to the pusher sleeve 121, and then the packer element 122 (see FIG. 1E). This weight also activates a sealing ring 182 (see FIG. 1C) between the packer setting assembly and the mandrel 104 to aid in setting the packer element with annulus pressure assist. Seal 181 maintains the seal between the packer setting assembly and the tieback 102. The lower portion of FIG. 1C illustrates the upper portion of a clutch 185 splined to the OD of the running tool mandrel 104 to transmit torque while allowing axial movement between the clutch and the mandrel. The central portion of the clutch 185 may move in response to biasing spring 183.

The first time the packer setting assembly is moved out of the polished bore receptacle, a trip ring may snap to a radially outward position. When the packer setting assembly is subsequently reinserted into the polished bore receptacle, the trip ring will engage the top of the polished bore receptacle, and the packer setting C-ring is positioned within the polished bore receptacle. When set down force is applied, and the trip ring will move radially inward due to camming action. The entire packer setting assembly may thus be lowered to bottom out on a lower portion of the running adapter prior to initiating the cementing operation. The next time the packer setting assembly is raised out of the polished bore receptacle, the radially outward biasing force of the C-ring will cause the C-ring to engage the top of the tieback. Further details regarding the packer seating assembly are disclosed in U.S. Pat. No. 6,739,398, hereby incorporated by reference.

The packer element 122 may be of a construction as described in U.S. Pat. No. 4,757,860, hereby incorporated by reference, comprising an inner metal body for sliding over the cone and annular flanges or ribs which extend outwardly from the body to engage the casing. Rings of resilient sealing material may be mounted between such ribs. The seal bodies may be formed of a material having substantial elasticity to span the annulus between the liner hanger and the casing C.

The closure subassembly 170 as shown in FIG. 1D may be disposed beneath the upper closure subassembly 110 shown in FIG. 1B. The lower closure subassembly 170 is secured within the running tool bore by shear pins 172. Sleeve 174 thus supports seat 176. The ball 118 when released from the upper closure will land onto the lower closure. Once the ball is seated on the lower closure, the predetermined pressure may be applied to shear pins 172 and move the ball seat 176 and the sleeve 174 downward to uncover the ports 173. Higher fluid pressure may then be applied to cause the piston sleeve 177 to move upward and thereby disengage the running tool from the set liner hanger. Assembly 170 releases the remainder of the tool to be retrieved to the surface from the set liner. Upon raising of the inner piston 177, the running tool may be raised from the set liner hanger.

FIG. 1D also illustrates a hydrostatic balance piston 175 for balancing fluid pressure across the seal 193 to increase high reliability for the operation of sleeve 174. More particularly, piston 175 may be pumped upward at substantially atmospheric pressure prior to running the tool in the well. As the tool is lowered in the well and hydrostatic pressure increases, the increased pressure above the piston 175 will be balanced by a substantially identical pressure below piston 175, and thus is the pressure in the cavity between piston 175 and sleeve 174, resulting in some downward movement of piston 175 to equalize pressure. Seals 193 above and below port 173 are thus subjected to substantially the same fluid pressure on both sides of the seals, thereby enhancing operation of the sleeve 174. FIG. 1D also illustrates split ring 178 for gripping the liner hanger 70. The split ring may be moved radially to position so that it may contract radially inward, thereby releasing the running tool from the liner hanger.

FIG. 1G illustrates a lower portion of the tool, including a ball diverter 140 and a liner wiper plug release assembly 150. The assembly 150 replaces the need for shear screws to secure the liner wiper plug to the running tool. The plug holder shown in FIG. 1G is functionally similar to the plug release assembly disclosed in U.S. Pat. 6,712,152, hereby incorporated by reference. Tool components and operations not detailed herein may be functionally similar to the components and operations discussed in U.S. Pat. No. 6,681,860, hereby incorporated by reference.

Figure 2:
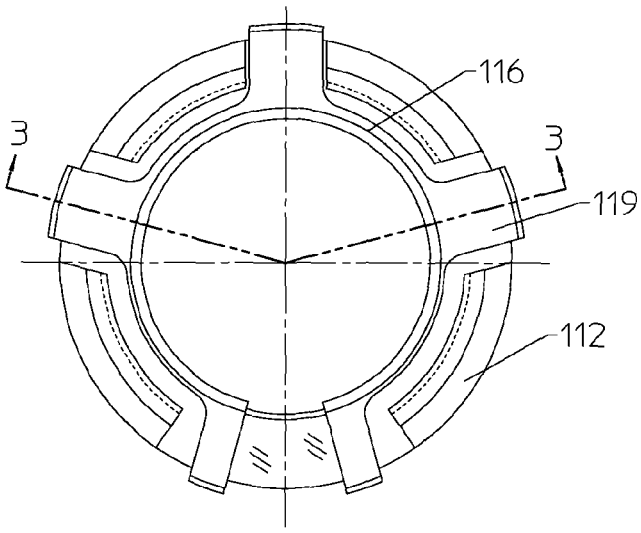
FIG. 2 illustrates in greater detail a top view of the upper closure seat subassembly shown in FIG. 1B.
Figure 3:
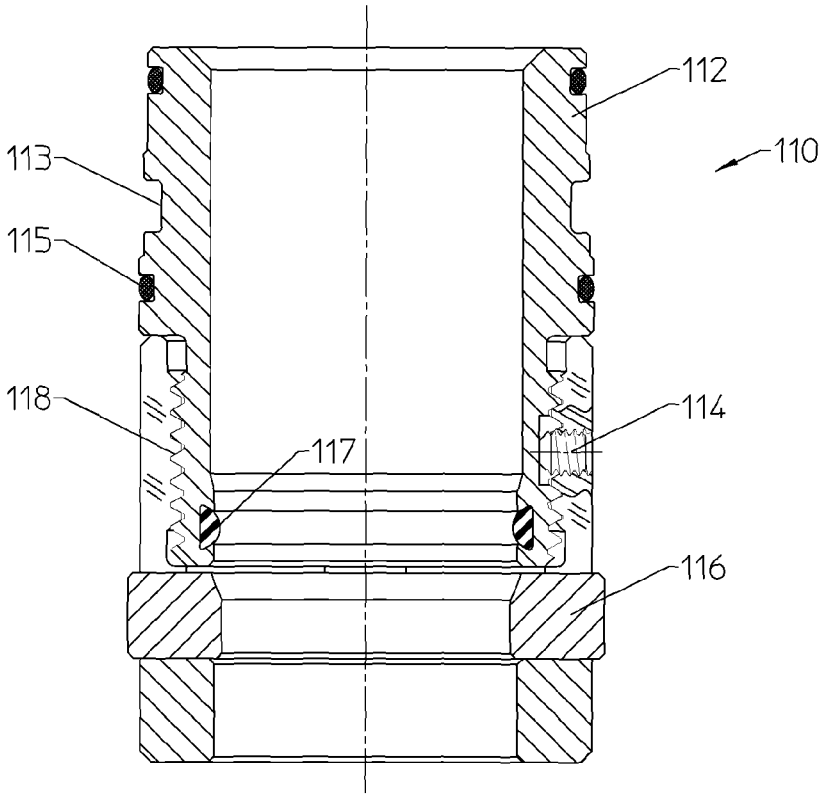
FIG. 3 is a cross-sectional view of the upper closure seat subassembly shown in FIG. 2.
Figure 4:
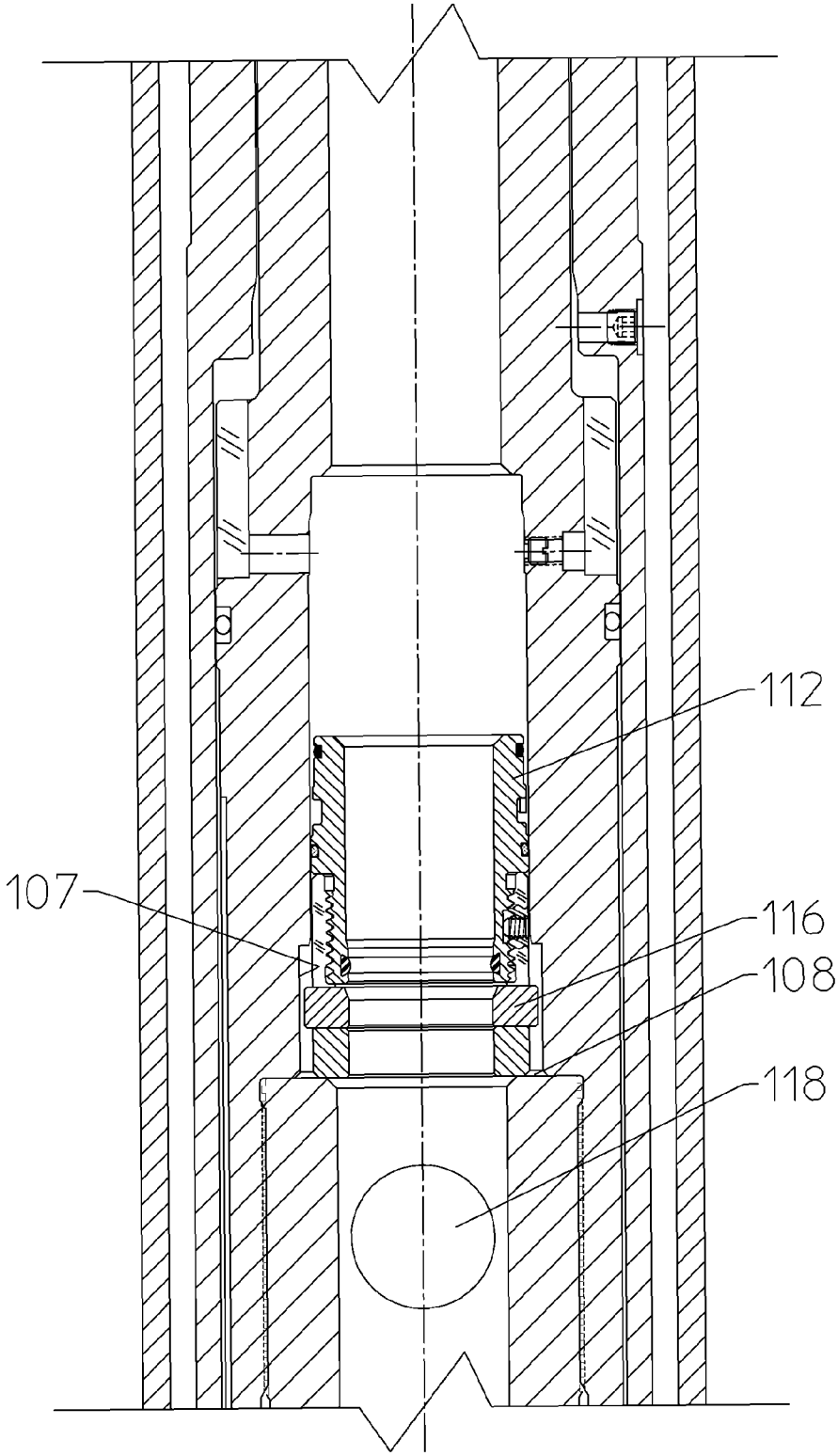
FIG. 4 shows the closure shifted downward, allowing for the release of the ball from the upper closure seat assembly.

Referring now to FIGS. 2 and 3, the upper closure subassembly which serves as a tool actuator for releasing the slips is shown in greater detail. Once the ball has landed on the closure seat 116, it is sealed with sleeve 112 by seal 117. The operator may then increase fluid pressure in the bore above the seated ball, until the shear pin 114, as shown in FIGS. 1B and 3, is sheared or otherwise disabled to release the subassembly to move in a manner of a piston until the lower end of the seal body or sleeve 112 engages the stop shoulder 108, as shown in FIG. 4. When in this position, the C-ring 116, which had been retained in its compressed position by the inner surface of the mandrel which acts as a C-ring retainer, has been axially moved to a lower expanded position upon entering the larger diameter bore 107 above the stop surface 108. Releasing the C-ring 116 to its normally relaxed and expanded position thus allows the ball to drop through the C-ring. When the subassembly is in the lower position as shown in FIG. 4, the C-ring has thus expanded to release the ball. FIG. 3 illustrates a set screw 114 to prevent inadvertent unthreading of threads 118 which connect the upper body portion with the lower body portion, with the lower body portion including upwardly projecting fingers with internal threads connected to the upper body portion.

The C-ring 116 as shown in FIG. 2 has a plurality of radially outward projections 119 that each pass through circumferentially spaced slots in the body 112. The outer surface of the projections 119 engage the inner wall of the mandrel 104 to retain the C-ring in its compressed position prior to shearing the pins 114 shown in FIG. 1B. To maintain proper alignment of the C-ring within the bore of the mandrel, the C-ring may be split at the location of one of these projections 119, so that each end of the C-ring, as well as intermediate portions between these ends, has a projection to engage the bore of the mandrel.

Figure 5:
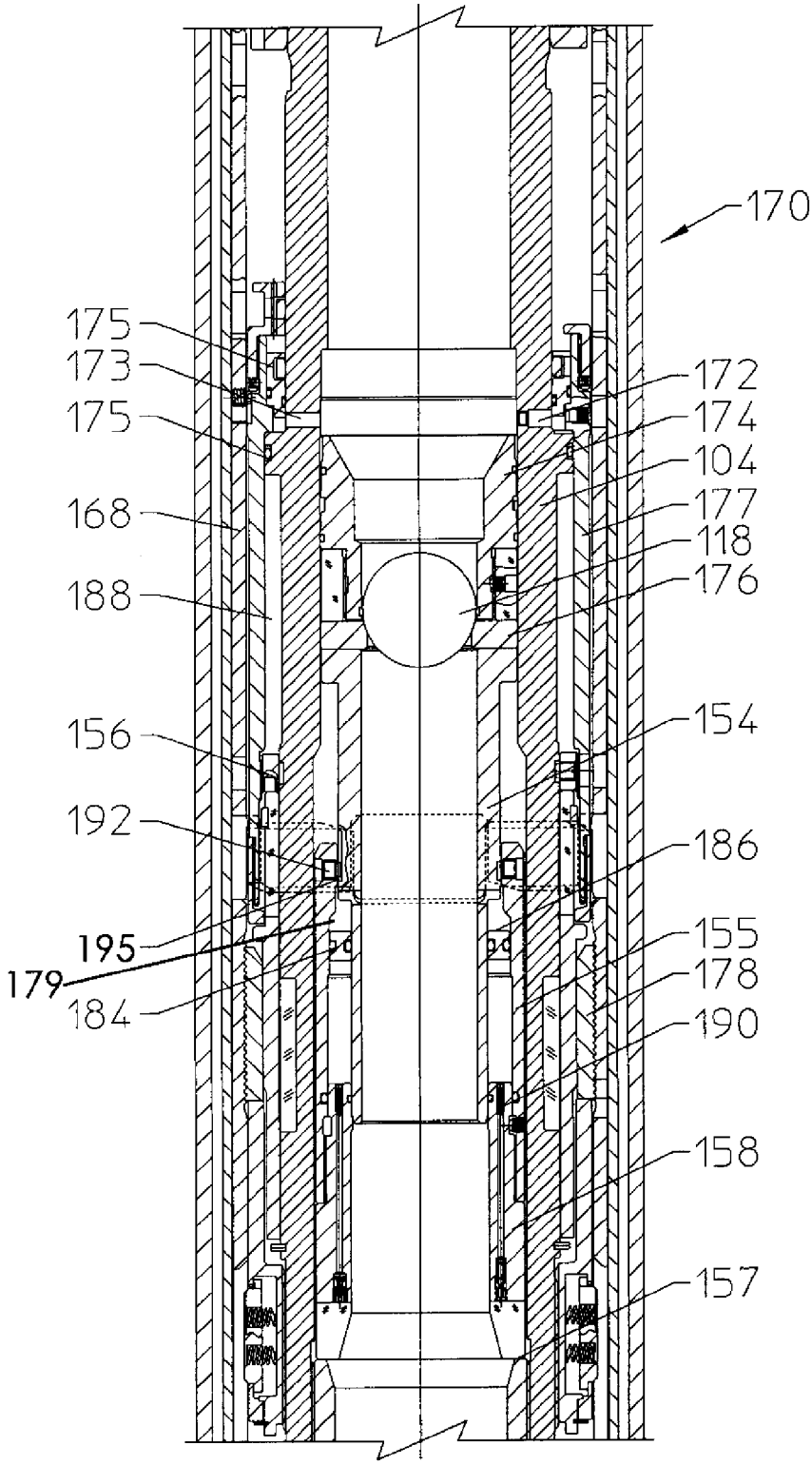
FIG. 5 depicts the hydraulic closure seat generally shown in FIG. 1D with a ball landed and the seat shifted downward.

The lower C-ring closure subassembly 170 as shown in FIG. 5 serves as a tool actuator for releasing the tool from the set liner, as explained above. Sleeve 174 includes a pair of elastomeric seals similar to the seals 117 shown in FIG. 3 for sealing with the mandrel. In this application, the sleeve 174 has an axially extended lower portion 154, with its lower end sealed to end piece 158. A radially outer sleeve 155 is pinned at 156 to lower portion 154 of sleeve 174, and the lower end of sleeve 155 threaded at 154 to end piece 158. The lower end of portion 154 and the outer sleeve 155 are each sealed to an upper end of end piece 158.

When in the upper position as shown in FIG. 1D, the shear pins 172 maintain the entire subassembly in the upward position. Once the ball lands on the seat 176 and pressure increases above the seated ball, the increased fluid pressure will shear the pins 172, moving the subassembly downward until end piece 158 engages stop 159, as shown in FIG. 5. Pressure may then be increased to release the slips, and then further increased to release the running tool, as explained above.

Figure 6:
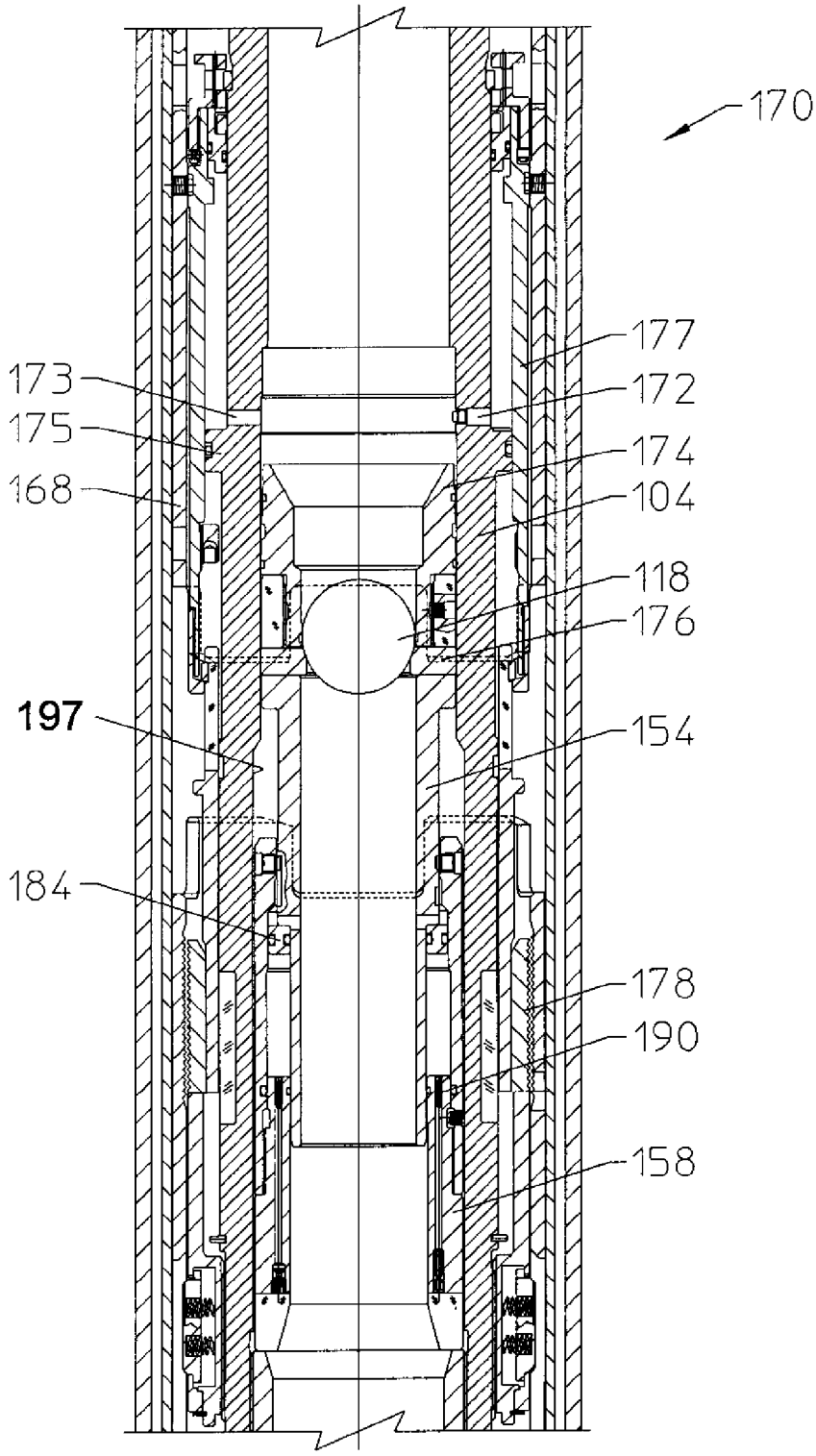
FIG. 6 depicts the closure seat as shown in FIG. 5 shifted to shear a first set of shear pins.

With the lower ball seat shifted downward to the position shown in FIG. 5, pressure may be further increased to shear pins 156. Upon shearing pins 156, fluid pressure forces the ball and sleeve 174 downward, until the shoulder 179 as shown in FIG. 5 engages the piston 184 spaced between lower portion 154 and sleeve 155, thereby initiating the release of the ball. Chamber 188 below piston 184 may house a clear hydraulic fluid, which is forced by the moving piston to flow through one or more check valves 186 in end piece 158 for a predetermined time, thereby slowly lowering the ball seat 176 until it expands into the larger diameter opening 197 (see FIG. 6), thereby expanding the seat to release the ball. Circulation is then returned and the ball drops to the ball diverter.

The lower ball seat 176 desirably absorbs any substantial shock force when the ball initially lands on the seat 176. With the ball on the C-ring seat, the system is fluidly closed, and any level of pressure may be applied to the system. Low pressure (e.g., 600 psi) that is applied may shear the shear pins 172 and allow the sleeve and C-ring seat to move down into a position that will allow for higher pressure to be applied to the system to do other work on a downhole tool, such as setting liner hanger slips (e.g., 1000 psi), or releasing a liner hanger running tool from a liner hanger (e.g., 2000 psi). Once these tasks have been performed, higher pressures (e.g., 3500 psi) may be applied to start the ball releasing sequence, shearing pins 156. The piston 184 moves downward as fluid in the space below the piston 184 is vented through the orifices 190. The type and volume of fluid vented and the size of the orifice will determine the time it takes to move the piston downward to release the ball. This time delay will give the operator time to release or reduce the pressure in the drill pipe before the ball comes off the seat. With the pressure reduced, there will not be a strong surge in the drill pipe or liner that could damage the formation. Pressure to do the work may be low (e.g., 500 psi) to high pressure (e.g., 3000 psi) without fear of prematurely releasing the ball from the seat and not getting the desired tasks performed. Once the tasks have been performed, pressure can be increased to releasing pressure (e.g., 3500 psi) and this pressure then reduced (e.g., to 500 psi) over a short time after the pins 156 have sheared, such that the ball will release from the seat without high pressure damaging the formation.

A significant advantage of the lower closure mechanism as shown in FIGS. 1D and 5 is that any desired fluid pressure, e.g., from several hundred to several thousand psi, may be used to reliably perform one or more tool operations, e.g., releasing the slips for setting, or releasing the set liner hanger from the running tool. In many cases, high fluid pressures are desired for some tool operations to increase their effectiveness, or to ensure activation at pressures above other tool operation activation pressures. Once these operations are complete, a relatively low fluid pressure may be used to pass the ball through the expanded C-ring seat. Since the final ball release operation may be performed at a pressure less than, and in many cases significantly less than, the one or more previously performed tool operation pressures, there is less likelihood of damaging the skin of downhole formations during the ball releasing operation.

In order to reduce the likelihood of a ball discharged from an upper seat assembly landing on and inadvertently passing through a lower seat assembly, the lower seat assembly preferably includes one or more sets of axially spaced shear pins 192 between the seat sleeve 154 and the sleeve 155. One set may be tightly positioned within a hole provided in the seat sleeve 154, while another set may be positioned within a vertical slot 195 within the same sleeve, as shown in FIG. 5. A ball landed on the seat 176 while positioned as shown in FIG. 5 will first cause shearing of the shear pins in the spot faced holes in sleeve 154. Limited downward movement of the seat sleeve 154 relative to sleeve 155 may occur until the other shear pins hit the upper end of the respective vertical slots 195. Due to the energy absorbed by shearing the shear pins in the spot faced holes, the additional shear pins are not sheared when the first pins are sheared, which prevents the tool from improperly actuating or passing the ball through the lower seat. The first shear pins may have substantially the same pressure rating as the additional shear pins, and may shear at the desired pressure level. Comparing FIGS. 1D, 5 and 6, the first set of shear pins 192 in the holes in sleeve 154 will shear, with the additional shear pins in slots 195 ready to shear.

Figure 7:
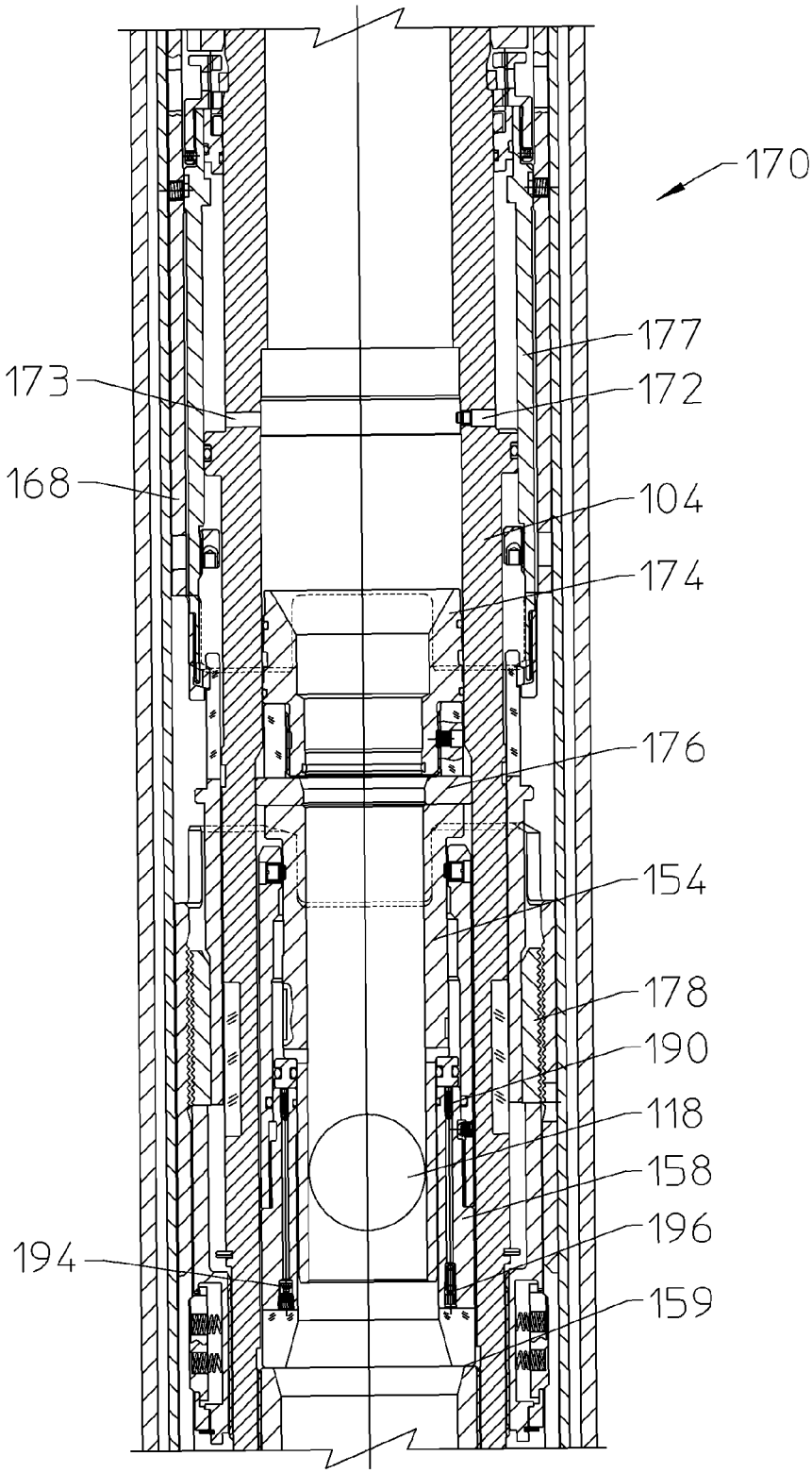
FIG. 7 depicts the closure seat shifted downward such that the seat expands to release the ball.

As discussed above, once the ball lands on seat 176 of the hydraulic closure subassembly 170, fluid pressure above the ball shears the pins 172, as shown in FIG. 5, and allows the ball and the seat to move downward until the stop surface 159 is engaged. Fluid pressure upon the ball pen shears pins 156 to move the ball and sleeve 154 down during a predetermined amount of time. This time allows the operator to reduce pressure in the system so when the ball releases, the pressure will not surge and harm the formation. A filter 190 and a rupture disk 194 are also shown in FIG. 7 spaced along the flow path which includes the orifice 196. The rupture disk 194 may be fractured if the restricted flow path plugs.

Those skilled in the art should now appreciate that the upper C-ring closure subassembly 110 as shown in FIG. 1B may be used in a liner hanger running tool to set the slips, and that the lower closure subassembly 170 as shown in FIGS. 1D may be used to release the running tool from the set liner hanger, with both closure assemblies cooperating with a single ball. In one alternative embodiment, the upper closure assembly alone, or only the lower closure subassembly alone, may be used to operate the liner hanger tool, either because the slips are otherwise set or the assembly is otherwise released from the liner hanger, or because a single closure subassembly may be used to both set the slips and thereafter release the tool from the set liner. In the former case, the slips may be set by an alternative mechanism which does not utilize increased pressure in the bore of the tool to actuate the tool, and the closure subassembly may be used to release the running tool from the set assembly. In another alternative, the running tool may be released from the set liner hanger by a mechanism that does not involve an increase in fluid pressure in the tool, and thus the closure subassembly may be used to only set slips. In a second alternative embodiment, both operations may be performed by the same closure subassembly. A wide range of fluid pressures are thus available to safely and reliably perform different operations at different fluid pressures. A single mechanism may be provided since relatively low pressures may be used to set the slips and then reliably move the closure to a position where it may expand within the running tool mandrel and thereby release the ball. For example, a fluid pressure of 1000 psi may be used to set the slips, while a fluid pressure of 2000 psi may be used to release the running tool from the set liner hanger then release the ball. Two or more piston may thus be actuated to perform the desired operations on the tool, and different fluid pressure levels and porting to the different pistons may be used to perform dual or multiple operations with a tool. Providing a comparatively low ball releasing pressure reduces the likelihood of high formation pressure damaging the skin of the formation, thereby enhancing hydrocarbon recovery.

Although a suitable location for the upper closure subassembly and the lower closure subassembly are shown in FIG. 1, the subassemblies may be positioned differently in another liner hanger running tool, including one with primary components of the assembly. One assembly includes both an upper closure and a lower closure. Since the lower closure may be used to release the running tool from downhole tubulars, such as a set liner, the ball or other closure reliably passes through the upper seat so that the closure may later pass through the lower seat and then release the tool. If a single closure subassembly is used in a liner hanger, the assembly may be positioned for porting to two different pistons which actuate the tool, e.g., the slip setting assembly and the liner hanger releasing assembly. The closure subassembly may be positioned at any location in the tool which provides a central bore through the tool and porting to the pistons.

In other applications, the closure subassembly may be used for performing downhole operations other than those involving a liner hanger, including tools involved in packer setting operations or multilateral operations, tubing/casing hanger running tools, subsea disconnect tools, downhole surge valves, ball releasing subs, hydraulic disconnect tools, and various types of downhole setting tools. In each of these applications, the tool may be reliably operated at relatively low pressures to release the ball or other closure compared to prior art tools due to the use of the C-ring seat mechanism. A significant feature of the invention is that a relatively low pressure and, more particularly, a pressure lower than the pressure required to release the ball or the closure from the upper seat, may be used to activate the lower seat. Moreover, the hydraulic action of the lower seat according to the present invention allows the ball releasing function to be effectively shock-absorbed, thereby providing for a "soft" release of the ball at a relatively low pressure.

In the above discussion, the ball or other closure member is used to seat with the closure subassembly and thereby increase fluid pressure. In other applications, other types of closure members may be used for seating with the closure subassembly and reliably sealing with the seal above the closure. Darts, plugs, and other closure members may thus be used for this purpose.

The tools disclosed herein is relatively simple, particularly with respect to the components which seat with the ball and subsequently release the ball from the seating surface, thereby providing high reliability and lower costs compared to prior art tools.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A downhole tool including a closure seat for receiving a closure and thereby increasing fluid pressure above the closure seat to perform an operation on the downhole tool and/or another downhole tool, comprising:

a tool mandrel having a central throughbore for providing fluid communication between a running string and an interior bore of the tool mandrel;

an axially movable closure seat positioned within the tool mandrel for seating with the closure while in a restricted portion of the interior bore in the tool mandrel to restrict radial expansion of the closure seat;

a seal body supporting and axially movable with the closure seat, the seal body including a lower body portion below the closure seat;

a restriction sleeve supporting the one or more fluid restrictions;

a stop for limiting downward movement of the restriction sleeve;

a connector for temporarily limiting axial movement of the closure seat with respect to the tool mandrel;

another connector interconnecting another sleeve and the lower portion of the seal body; and an actuating piston axially movable with respect to the tool mandrel when the connector is disabled to axially move the closure seat, the actuating piston pressuring a fluid chamber within the tool mandrel such that fluid passes from the fluid chamber through one or more fluid restrictions while the actuating piston moves to reduce the fluid chamber volume and thereby axially move the closure seat to a radially expanded position within the tool mandrel to allow the closure seat to release the closure.

2. The downhole tool as defined in claim 1, further comprising:

the axially movable seat has a first axial position for closing off a through port in the seat, a second axial position in which the connector is disabled, and a third axial position in which the closure is released.

3. The downhole tool as defined in claim 1, further comprising:

an annular seal positioned above the closure seat for sealing with the closure while seated on the closure seat.

4. The downhole tool as defined in claim 3, further comprising:

the seal body supporting the annular seal and having an external seal for sealing with the tool mandrel, the seal body being axially movable with the closure seat.

5. The downhole tool as defined in claim 1, wherein the restriction sleeve seals with both the lower portion of the seal body and the another sleeve.

6. The downhole tool as defined in claim 1, wherein one of the lower portion of the seal body and the another sleeve has a sealing surface for sealing engagement with the piston and an axially spaced surface with a diameter for fluid bypass of the actuating piston.

7. The downhole tool as defined in claim 1, further comprising:

a vent spaced above the actuating piston for preventing a vacuum lock as the piston moves downward.

8. The downhole tool as defined in claim 1, wherein the mandrel includes a large diameter portion for receiving an expanded diameter closure seat and allowing the closure to pass through the closure seat.

9. The downhole tool as defined in claim 1, wherein the tool body has a plurality of closure seats which sequentially operate the downhole tool and/or another downhole tool.

10. A downhole tool including a closure seat for receiving a closure and thereby increasing fluid pressure above the closure seat to perform an operation on the downhole tool and/or another downhole tool, comprising:

a mandrel having a central throughbore for fluid communication with an interior of a running string, a portion of the central throughbore having a restricted diameter;

an axially movable closure seat positioned within the restricted diameter portion of the mandrel and having a port in fluid communication with the passage in the mandrel;

a seal body supporting and axially movable with the closure seat, the seal body including a lower body portion below the closure seat;

a restriction sleeve supporting the one or more fluid restrictions;

a stop for limiting downward movement of the restriction sleeve:

a connector for temporarily limiting axial movement of the closure seat with respect to the tool mandrel, and releasing the closure seat to move axially to a radially expanded position within an enlarged portion of the interior bore in the tool mandrel to release the closure;

another connector interconnecting another sleeve and the lower portion of the seal body; and an actuating piston axially movable in response to axial movement of the closure seat when the connector is disabled, the actuating piston pressuring a fluid chamber such that fluid passes from the fluid chamber through one or more fluid restrictions while the actuating piston moves to reduce the fluid chamber volume and thereby axially move the closure seat to a radially expanded position within the tool mandrel to allow the closure seat to release the closure.

11. The downhole tool as defined in claim 10, wherein the restriction sleeve seals with both the lower portion of the seal body and the another sleeve.

12. The downhole tool as defined in claim 10, wherein one of the lower portion of the seal body and the another sleeve has a sealing surface for sealing engagement with the piston and an axially spaced surface with a diameter for fluid bypass of the actuating piston.

13. The downhole tool as defined in claim 10, wherein the tool mandrel includes an actuation port for passing fluid from above the sealed closure to operate the downhole tool and/or the another downhole tool.

14. A method of operating a downhole tool including a closure seat for receiving a closure and thereby increasing fluid pressure above the closure seat to perform an operation on the downhole tool and/or another downhole tool, comprising:

providing a tool mandrel having a throughbore;

providing an axially movable and radially retracted closure seat positioned within a restricted portion of the tool mandrel for seating with the closure, the closure seat having a through port in fluid communication with the through passage in the tool mandrel;

disabling a first connector to allow initial downward movement of the seal body, and a second connector is disabled to allow further downward movement of the seal body with respect to the another sleeve, and fluid pressure to disable the second connector is significantly less than the fluid pressure required to expand the closure seat;

axially securing a connector between the seat and the tool mandrel;

in response to mandrel internal pressure, disabling the connection to release the seat to move axially within the tool mandrel; and thereafter moving a piston axially relative to the tool mandrel to pressurize a fluid chamber, such that fluid passes from the fluid chamber through one or more fluid restrictors to allow the closure seat to further move axially and radially expand to release the closure from the closure seat.

15. The method as defined in claim 14, further comprising:

providing an annular seal for sealing with the closure while seated on the closure seat.

16. The method as defined in claim 14, further comprising:

supporting a seal body axially movable with the closure seat, the seal body including a lower body portion below the closure seat;

providing the one or more fluid restrictions on a restriction sleeve;

limiting downward movement of the restriction sleeve with a stop; and interconnecting the restriction sleeve and the lower portion of the seal body.

17. The method as defined in claim 14, further comprising:

providing an external seal on the seal body for sealing with the central throughbore in the downhole tool.

18. The method as defined in claim 14, wherein the connector interconnects the seal body and the mandrel; and providing another connector to interconnect the seal body and another sleeve.

19. The method as defined in claim 16, wherein the restriction sleeve seals with both the lower portion of the seal body and another sleeve.

20. The method as defined in claim 14, wherein the tool mandrel includes an actuation port for passing fluid above the seated closure to operate the tool and/or another downhole tool.

* * * * *